US009079114B2

(12) United States Patent
Efremenko

(10) Patent No.: US 9,079,114 B2
(45) Date of Patent: Jul. 14, 2015

(54) RATTLE TUMBLER TOY

(76) Inventor: Vladimir Nikolaevich Efremenko, Rostov-na-Donu (RU)

( * ) Notice: Subject to any disclaimer, the term of this patent is extended or adjusted under 35 U.S.C. 154(b) by 180 days.

(21) Appl. No.: 13/640,271

(22) PCT Filed: Dec. 1, 2011

(86) PCT No.: PCT/RU2011/000946

§ 371 (c)(1),
(2), (4) Date: Oct. 9, 2012

(87) PCT Pub. No.: WO2012/165999

PCT Pub. Date: Dec. 6, 2012

(65) Prior Publication Data

US 2013/0288562 A1 Oct. 31, 2013

(30) Foreign Application Priority Data

Jun. 1, 2011 (RU) ..... 2011121965

(51) Int. Cl.
*A63H 5/00* (2006.01)
*A63H 15/06* (2006.01)
*A63H 3/28* (2006.01)

(52) U.S. Cl.
CPC ..... *A63H 15/06* (2013.01); *A63H 3/28* (2013.01); *A63H 5/00* (2013.01)

(58) Field of Classification Search
CPC ..... A63H 5/00; A63H 15/06; A63H 15/08; A63H 33/00; A63H 1/20; A63H 27/10; A63H 33/006
See application file for complete search history.

(56) References Cited

U.S. PATENT DOCUMENTS

| | | | | | |
|---|---|---|---|---|---|
| 901,762 | A | * | 10/1908 | Wetzel | 446/297 |
| 2,554,516 | A | * | 5/1951 | Anthony | 446/325 |
| 3,921,331 | A | * | 11/1975 | Schatz | 446/297 |
| 4,272,911 | A | * | 6/1981 | Strauss | 446/459 |
| 4,771,902 | A | * | 9/1988 | Teng | 215/376 |
| 5,169,354 | A | * | 12/1992 | Norton et al. | 446/241 |
| 5,221,225 | A | * | 6/1993 | Newbold et al. | 446/297 |
| 5,808,215 | A | * | 9/1998 | Kralik et al. | 84/402 |
| 6,006,930 | A | * | 12/1999 | Dreyer et al. | 215/44 |
| 6,061,937 | A | * | 5/2000 | Meng | 40/409 |
| 6,139,396 | A | * | 10/2000 | Lin | 446/267 |
| 6,165,041 | A | * | 12/2000 | Lin | 446/267 |
| 6,217,408 | B1 | * | 4/2001 | Willinger | 446/396 |
| 6,268,027 | B1 | * | 7/2001 | Wu | 428/13 |

(Continued)

FOREIGN PATENT DOCUMENTS

GB 2267229 A * 12/1993

*Primary Examiner* — Gene Kim
*Assistant Examiner* — Alyssa Hylinski
(74) *Attorney, Agent, or Firm* — Bardmesser Law Group

(57) ABSTRACT

A rattle-tumbler toy, comprising a ball-shaped thin-walled body having two parts, one is a transparent reservoir and another is a non-transparent leak-proof cover connected to the first part of the body, a membrane on which a playing element is mounted and connected to the body cover. The transparent reservoir has a neck whose external surface has a collar for connection to mating parts on an internal surface of the cover when fastening the cover on the reservoir. When the body is assembled, the playing element is mounted in the transparent reservoir. The membrane is a thin-walled tumbler. The membrane is mounted in the inner space of the neck to place the playing element in the transparent part of the body. The transparent part of the body has freely arranged balls, and in the place of connection of the cover's wall to the transparent reservoir's wall there is a seal.

3 Claims, 14 Drawing Sheets

(56) References Cited

U.S. PATENT DOCUMENTS

| | | | | |
|---|---|---|---|---|
| 6,464,602 | B1 * | 10/2002 | Rottger | 473/571 |
| 6,880,273 | B2 * | 4/2005 | Lo | 40/406 |
| 7,166,047 | B2 * | 1/2007 | May et al. | 473/569 |
| 7,217,171 | B2 * | 5/2007 | Hsu | 446/300 |
| 7,258,591 | B2 * | 8/2007 | Xu et al. | 446/273 |
| 7,910,816 | B2 * | 3/2011 | Glowacki | 84/410 |
| 2002/0102906 | A1 * | 8/2002 | Fleisch et al. | 446/233 |
| 2002/0106968 | A1 * | 8/2002 | Herrenbruck | 446/475 |
| 2004/0217033 | A1 * | 11/2004 | Gordon et al. | 206/493 |
| 2004/0262310 | A1 * | 12/2004 | Silk | 220/288 |

* cited by examiner

FIG. 3
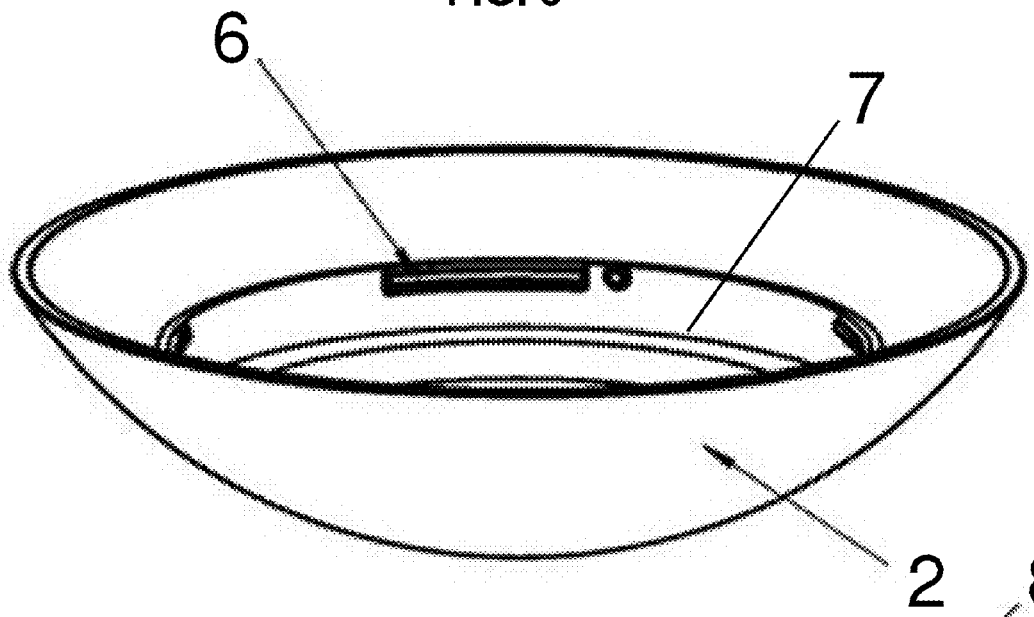
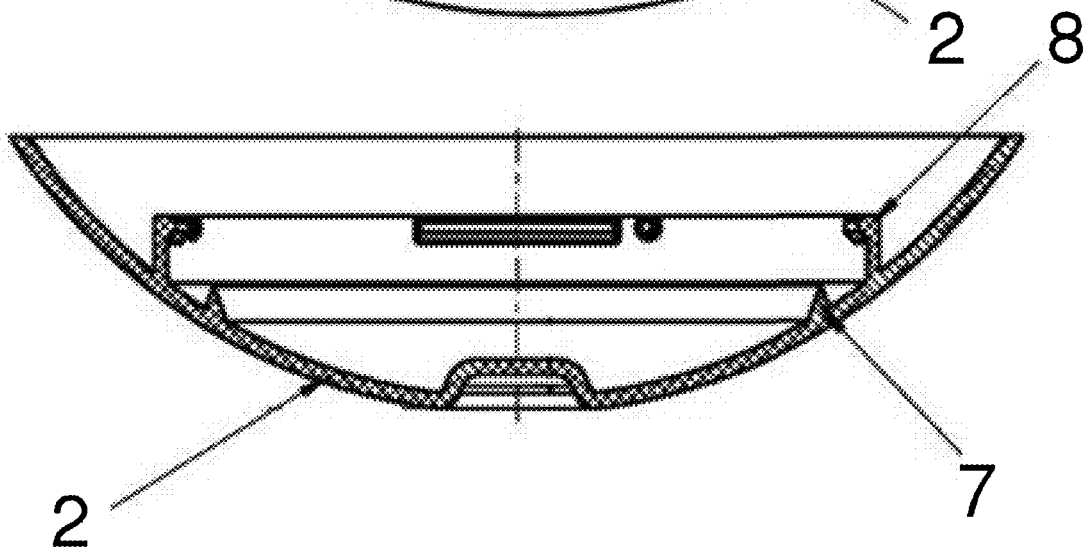
FIG. 4

RATTLE TUMBLER TOY

CROSS REFERENCE TO RELATED APPLICATIONS

This application is a U.S. National Phase of PCT/RU2011/000946, filed on Dec. 1, 2011, which claims priority to RU 2011121965, filed Jun. 1, 2011, which are incorporated herein by reference in their entirety.

BACKGROUND

1. Field of the Invention

The present invention relates to production of toys and especially to design of a tumbler toy.

2. Background of the Related Art

A "Tumbler" toy is known (RU No. 1547839, 1988), comprising a body formed by top and large low spherical reservoirs which are connected to each other, a weight located in the lower spherical reservoir, a hammer suspended by a swinging joint in the body capable of kinematic interaction with tuning forks mounted in the lower reservoir of the body, while the hammer is suspended by means of flexible thread, whose swing hanger is in the form of a ball hinge, and the ball of the hinge is capable of magnetic interaction with a magnetic plate fixed above the hinge.

One problematic feature of the toy is that both reservoirs are rigidly connected to each other, which makes the body un-detachable. When the mechanism, located in the body, is broken, for example, when the thread of the hammer, the hinge or tuning-fork of the mechanism is broken, the toy is beyond repair, as it is impossible to work inside the body. It is natural that the body is made un-detachable to prevent a child from casual access to the mechanism, which could injure the child. This was due to the fact that it was not possible to reliably connect two thin-walled reservoirs because of an absence of strong polymeric materials for producing a strong thin-walled cover of the body and techniques for production of a thin-walled construction by blowing or molding.

Another "Tumbler" toy comprising a body formed by top and large low spherical reservoirs which are connected to each other, a weight located in the lower spherical reservoir, a hammer swinging in the body capable of contact interaction during an angular deviation of the body with the tuning forks mounted in the lower reservoir of the body, is known (see GB Patent No. 1095943, 1967).

The problematic features of the toy regarding design of its body and access to the musical mechanism are the same as described for RU No. 1547839. Another problem is a small range of a musical range due to the hanging hammer. As the hammer has a hanger with fixed height, when the position of the body is changed, the hammer always hits the same spots in the tuning forks. Tuning forks are executed in the form of rods, whose frequency and volume depends on the location of the application of the hammer from top to bottom.

It is impractical to use such toys for playing in water, as any connection in the specified devices ultimately is broken and water leaks into the toy's inner space, which leads to a broken musical mechanism. Playing on water, for example, in a bathroom, when a child is washed, is of a great importance for the process of bathing of a child. Experience has shown that not all children behave equally patiently toward bathing, and many of them behave badly. To distract attention of a child from the process of washing, parents often use toys intended for use on water. A tumbler toy is a type of toys that always draws strong attention from children. In this connection, it is reasonable to add to the toy the property of a tumbler toy, providing possibility to play with it not only on a firm surface, but also on water.

For example, the toy can be designed in the form of a rattle-tumbler toy, comprising a ball-shaped thin-walled body of two parts, one of which is in the form of a transparent reservoir, and another is in the form of a non-transparent cover leak-proof connected to the first part of the body, a membrane on which the playing element is mounted and which is connected to the body cover. Thus, the transparent reservoir is made with a neck whose external surface has at least one collar for connection to the mating parts on the internal surface of the cover when fastening the non-transparent cover on the transparent reservoir. When the body is assembled, the playing element is mounted in the transparent reservoir (JP 2006087560, 2006).

However, a child can use it only in dry conditions, as ingress of moisture leads to a broken musical mechanism or leaks into the body. Since at an early age, a child cannot always correctly assess external conditions, then it is reasonable for the toy to possess leak-proof qualities and shape, enabling its contents to be always visible.

SUMMARY OF THE INVENTION

The object of the present invention is to achieve the technical result consisting in increasing of operational reliability when playing in water environment due to exception of ingress of moisture into the inner space of the transparent body.

The claimed technical result is achieved in that the inventive toy, designed in the form of a rattle-tumbler toy, includes a ball-shaped thin-walled body formed of two parts, one of which is in the form of a transparent reservoir, and another is in the form of a non-transparent cover leak-proof connected to the first part of the body, a membrane, on which the playing element is mounted, is connected to the body cover. Thus, the transparent reservoir is made with a neck whose external surface has at least one collar for connection to the mating parts on the internal surface of the cover when fastening the non-transparent cover on the transparent reservoir, and when the body is assembled, the playing element is mounted in the transparent reservoir. On the external surface of the neck of the transparent reservoir there are two collars spaced from top to bottom of the neck. One of which, located near to the end of the neck, is open at least in two places. The cover is in the form of two spaced from top to bottom collars, the first of which is directed along the long axis of the cover, and on the inside surface bears a ring clamp, which is open at least in two locations. The second collar is directed along the long axis of the cover and located inside the first collar. The membrane is made in the shape of a thin-walled tumbler, along the edge of the side board of which there is a flange. In the centre of the membrane's bottom there is a hole to pass a screw element to connect the playing element to the external surface of the tumbler's bottom. Thus, the membrane with the fixed playing element is mounted in the inner space of the neck to mount the playing element in the transparent part of the body, with leaning of the flange on the end of the neck and location of the side board of the tumbler between the inner surface of the neck and the second collar on the cover. Thus, in the transparent part of the body, there are freely arranged balls, and in the place of connection of the cover's wall to the transparent reservoir's wall, there is a seal.

The claimed technical result is also achieved in that the inventive toy, designed in the form of a tumbler toy, comprising a ball-shaped thin-walled body comprising two parts, one of which is in the form of a transparent reservoir, and another is in the form of a non-transparent cover leak-proof connected to the first part of the body. A membrane, on which the playing element is mounted, is attached to the body cover. Thus, the transparent reservoir is made with a neck whose external surface has at least one collar for connection to the mating parts on the internal surface of the cover when fastening the non-transparent cover on the transparent reservoir.

When the body is assembled, the playing element is mounted in the transparent reservoir. The playing element has a tuning-fork mechanism. The playing element is detachable, and has at least two joinable parts. On the external surface of the neck of the transparent reservoir there are two collars spaced from top to bottom of the neck. One of which, located near to the end of the neck, is open at least in two places. The cover is made in the form of two collars spaced from top to bottom, the first of which directed along the long axis of the cover, bears inside the ring clamp, which is open at least in two places.

The second collar is directed along the long axis of the cover and located inside the first collar. The membrane is made in the shape of a thin-walled tumbler, along the edge of the side board of which there is a flange. In the centre of the membrane's bottom there is a hole to pass a screw element to connect one part of the playing element with the tuning-fork mechanism to the external surface of the tumbler's bottom. Thus, the membrane is mounted in the inner space of the neck to place the playing element in the transparent part of the body and with leaning of the flange on the end of the neck and location of the side board of the tumbler between the inner surface of the neck and the second collar on the cover. In the transparent part of the body there are holes for water and draining it, and in the place of connection of the cover's wall to the transparent reservoir's wall there is a seal.

The claimed technical result is achieved in that the inventive toy designed in the form of a musical toy, comprising a ball-shaped thin-walled body comprising two parts, one of which is in the form of a transparent reservoir, and another is in the form of a non-transparent cover sealably connected to the first part of the body. A membrane on which the playing element is mounted whose is connected to the body cover. The transparent reservoir is made with a neck whose external surface has at least one collar for connection to the mating parts on the internal surface of the cover when fastening the non-transparent cover on the transparent reservoir. When the body is assembled, the playing element is mounted in the transparent reservoir, and has an additional membrane, in which a nipple valve is mounted, which is made in the form of a thin-walled tumbler, whose side board has a flanging and the tuning-fork mechanism.

The playing element is detachable, and has at least two joinable parts. On the external surface of the neck of the transparent reservoir there are collars to form a screw line, the cover is made in the form of two spaced from top to bottom collars, the first of which directed along the long axis of the cover and bears inside the collars to form a screw line. The second collar is directed along the long axis of the cover and located inside the first collar. The membrane is made in the shape of a thin-walled tumbler, along whose edge of the side board there is a flange. In the centre of the membrane's bottom there is a hole to pass a screw element to connect one part of the playing element with the tuning-fork mechanism to the external surface of the tumbler's bottom in which through holes are made.

Thus the additional membrane is put into the membrane, having the tuning-fork mechanism, and the flange of the additional membrane is located on the flange of the membrane with the tuning-fork mechanism, both membranes are mounted in the inner space of the neck to locate the playing element in the transparent part of the body and with leaning of the flanges on the end of the neck and location of the side boards of both tumblers between the inner surface of the neck and the second collar on the cover. In the place of connection of the cover's wall to the transparent reservoir's wall there is a seal. The cover on the inner side is made with a housing to place a part of the nipple valve of the additional membrane. In the housing there is a through hole to have access to that nipple valve when pumping air into the body's inner space.

Additional features and advantages of the invention will be set forth in the description that follows, and in part will be apparent from the description, or may be learned by practice of the invention. The advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and, together with the description, serve to explain the principles of the invention.

In the drawings:

FIG. 3 is a general layout of the cover;

FIG. 4 is a vertical section of the cover of FIG. 3 construction;

DETAILED DESCRIPTION OF EMBODIMENTS OF THE INVENTION

Reference will now be made in detail to the preferred embodiments of the present invention, examples of which are illustrated in the accompanying drawings.

A toy in the form of a sphere with a rattle, transparent, about 60 mm diameter, intended for playing both on a solid surface and in water due to its leak-proof outer cover, is described.

According to the first embodiment, a toy made as a rattle (see FIG. 1-5) comprising a thin-walled body of a spherical shape comprising of two connected parts, one of which is a transparent reservoir 1, and the other is a non-transparent cover 2 connected in a leak-proof manner to the first part of the body.

The transparent reservoir has a neck 3 whose external surface has at least one collar for connection to mating parts on the internal surface of the cover 2 when fastening the non-transparent cover 2 on the transparent reservoir 1.

Figure 2:
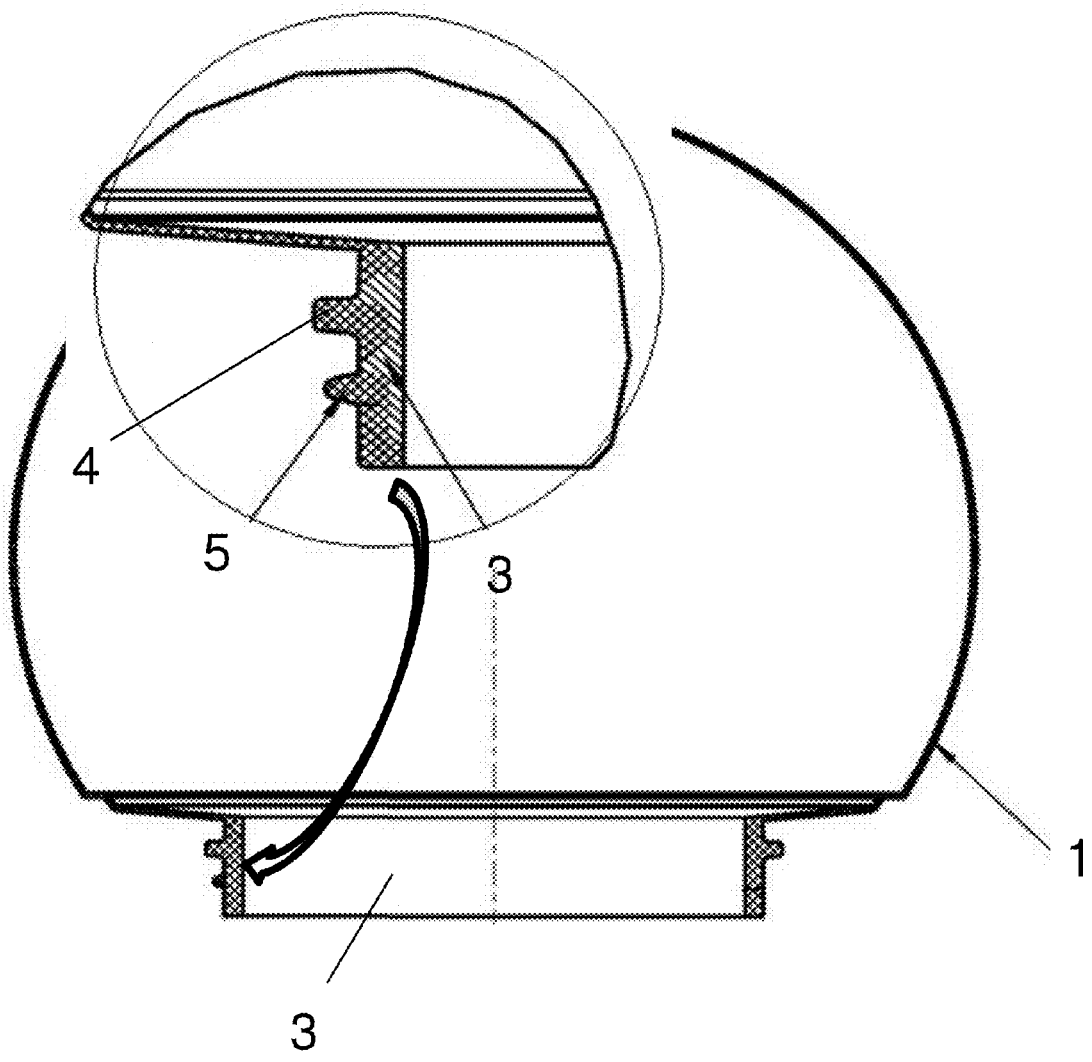
FIG. 2 is a general layout of the transparent reservoir.
Figure 5:
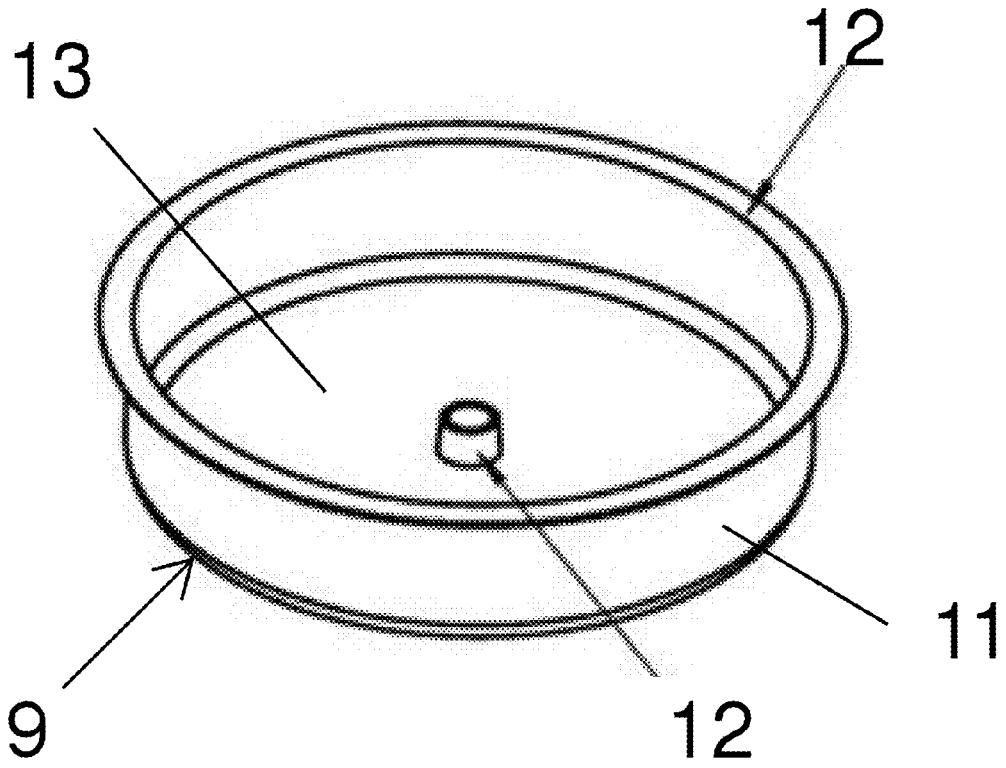
FIG. 5 is a general layout of the membrane.

On the external surface of the neck 3 of the transparent reservoir 1 there are two collars 4 and 5, spaced from top to bottom of the neck 3 and one of which, which is located closer to the end of the neck 3, is open at least in two places (see FIG. 2).

The cover 2 is made in the form of two collars 6 and 7 spaced from top to bottom, the first of which (6) is directed along the long axis of the cover 2, bears inside the ring clamp 8, which is open at least in two places, and the second collar (7) is directed along the long axis of the cover and located inside the first collar 6. The collar 7 has a triangular form in section (see FIGS. 3, 4). Making the collars 6, 7 open allows to implement a bayonet connection of the cover 2 and the neck 3. The collars (4, 5) of the cover 2 enter between the gaps of the neck's collars (6, 7) and then are nested under the latter by a slight turn of the cover 2 around the neck 3.

The inventive toy has a thin-walled membrane 9 (FIG. 5), on which the playing element 10 is mounted and which is connected to the body cover 2. The playing element 10 is made in the form of a doll, fairy-tale character, shape of an animal, etc. When the body is assembled, the playing element 10 is mounted in the transparent reservoir 1. The membrane 9 is made in the shape of a thin-walled tumbler, along the edge of the side board 11 of which there is a flange 12, in the centre of the membrane's bottom 13 there is a hole to pass a screw element 14 (screw) to connect the playing element 10 to the external surface of the tumbler's bottom 13. In the center, the membrane 9 has a prominent cylindrical section 15 with a hole in which the screw is twisted to connect the membrane 9 with a figure of an animal.

Figure 1:
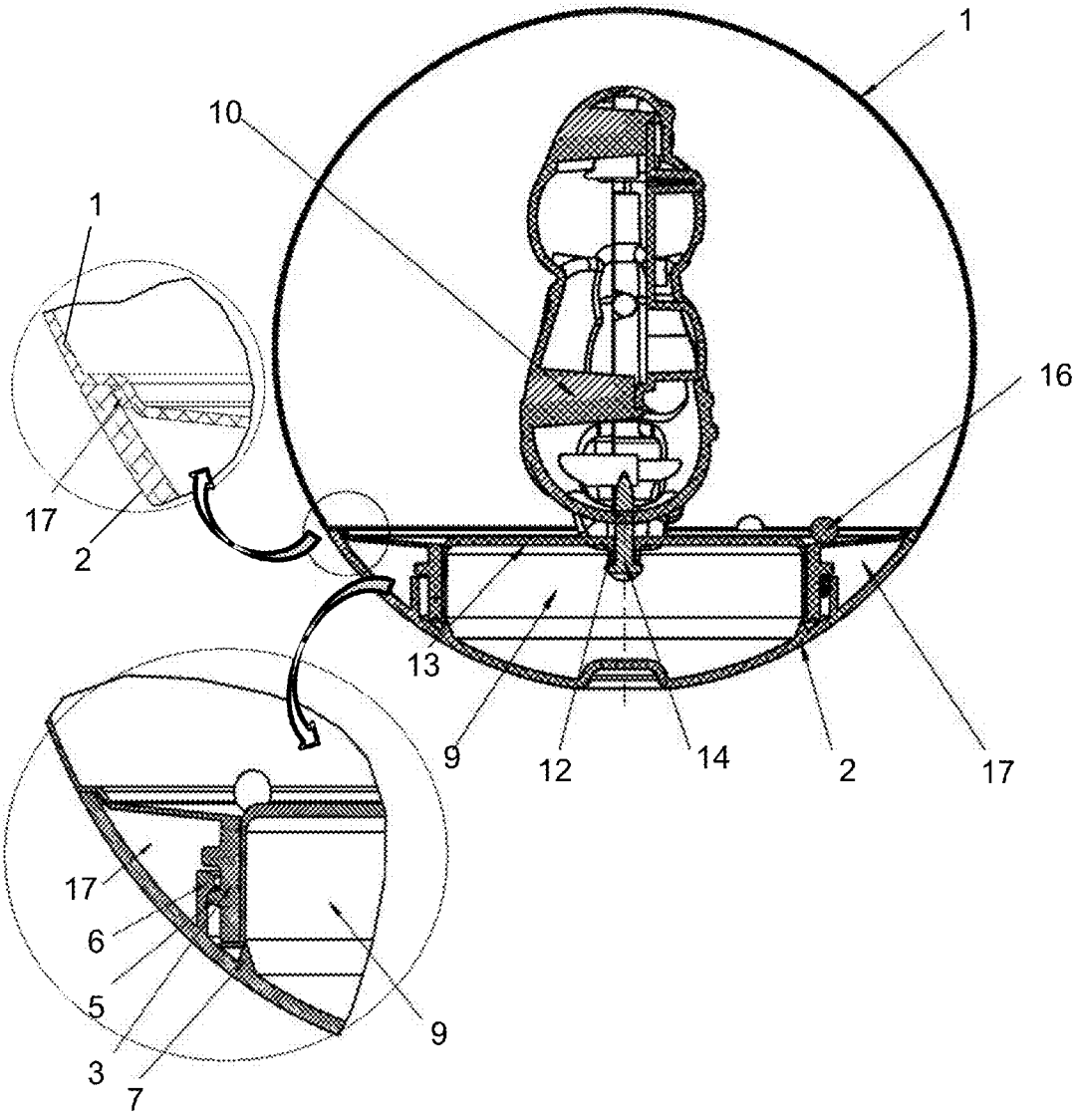
FIG. 1 illustrates a long section of the inventive toy in the form of a rattle.

The membrane 9 with the fixed playing element 10 is mounted in the inner space of the neck 3 to place the playing element 10 in the transparent part of the body and with leaning of the flange on the end of the neck 3 and location of the side board of the tumbler between the inner surface of the neck 3 and the second collar on the cover (FIG. 1).

The membrane 9 seals the reservoir 1, tightening the neck 3 of the reservoir 1 on the joint surfaces. The membrane 9 is kept in the reservoir 1 due to nipping of the side surfaces of the membrane and the reservoir 1.

In the transparent part of the body there are freely arranged balls 16 that provide the rattling sound.

In the place of connection of the cover's wall to the transparent reservoir's wall there is a seal (a seal ring 17). The seal ring 17 prevents penetration of water into the reservoir 1 between the external part of the reservoir 1 and the rattler's bottom.

When the rattler is assembled, a figure of an animal is connected to the membrane 9 with a screw. The balls 16 are put into the reservoir 1. The membrane 9 with a figure of an animal is inserted into the reservoir 1. The seal ring 17 is placed on the reservoir 1, or glued. On the neck 3 of the reservoir 1 the cover 2 is screwed to, functioning as a bottom.

When the toy is rolling, the balls 16 make sounds. Thus, through the transparent part of the body, a doll or an animal and color balls 16 are seen.

Figure 7:
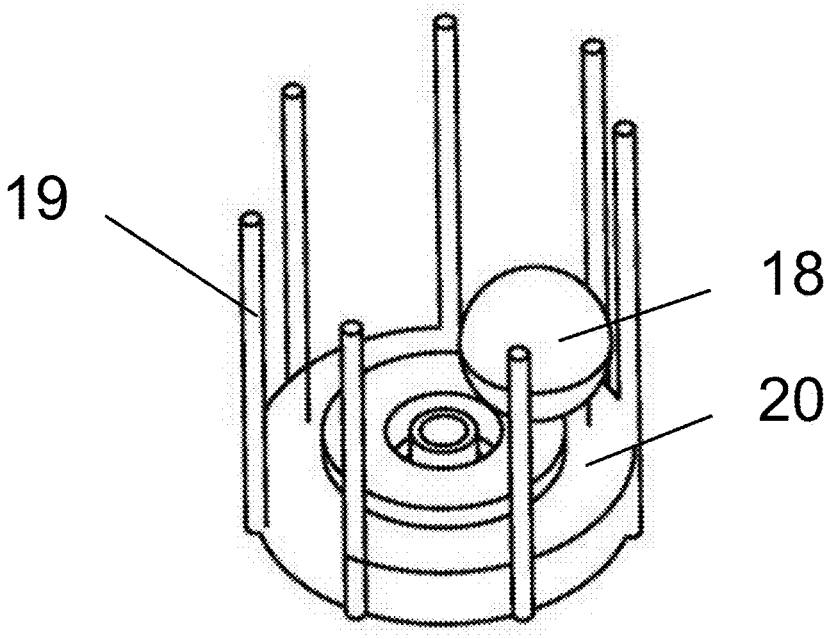
FIG. 7 is a general layout of the inventive tuning-fork mechanism.
Figure 8:
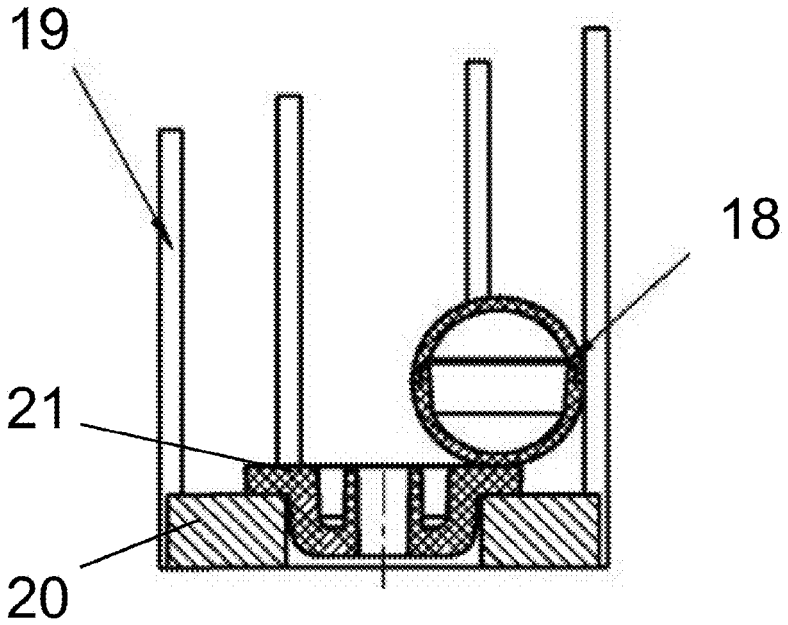
FIG. 8 is a vertical section of the mechanism of FIG. 7 construction.
Figure 9:
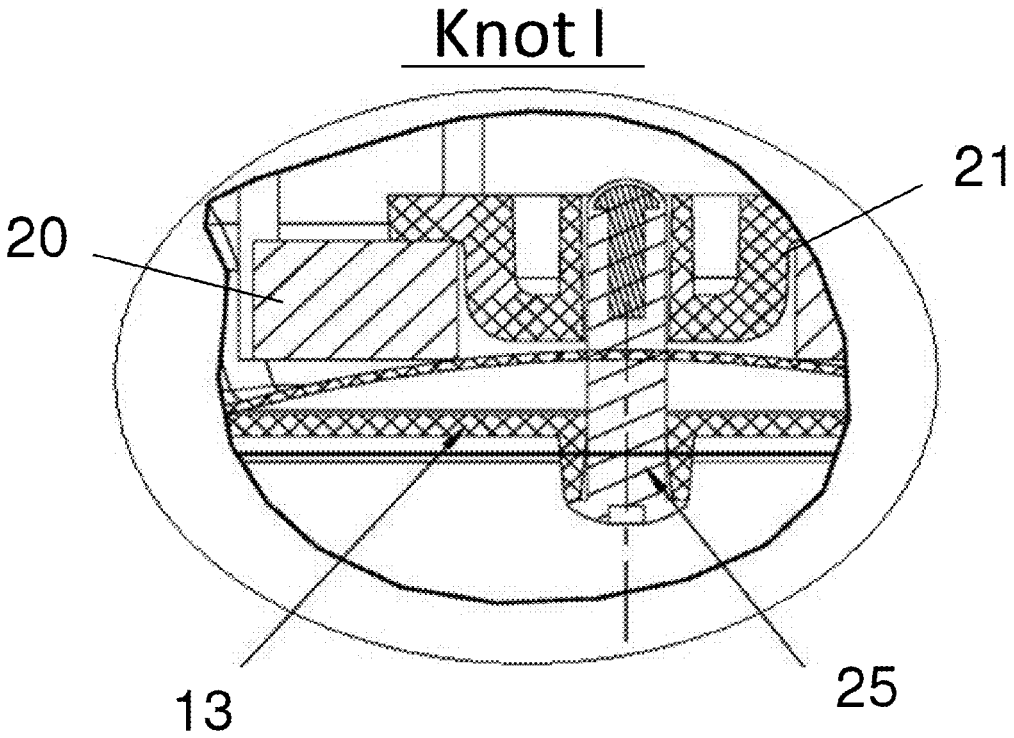
FIG. 9 is a node I of FIG. 6 construction.
Figure 10:
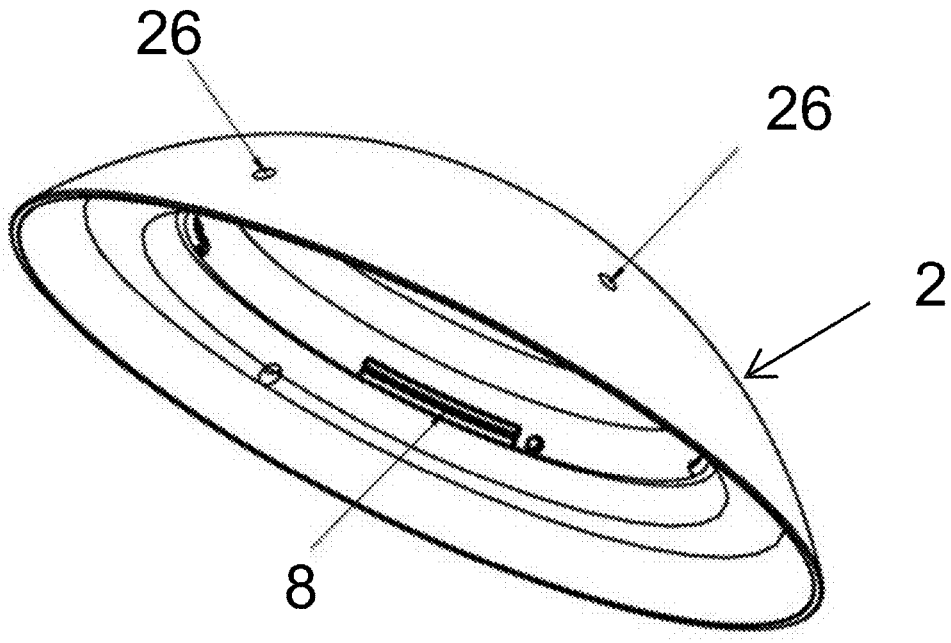
FIG. 10 is a general layout of the cover for the inventive toy of FIG. 6 construction.
Figure 11:
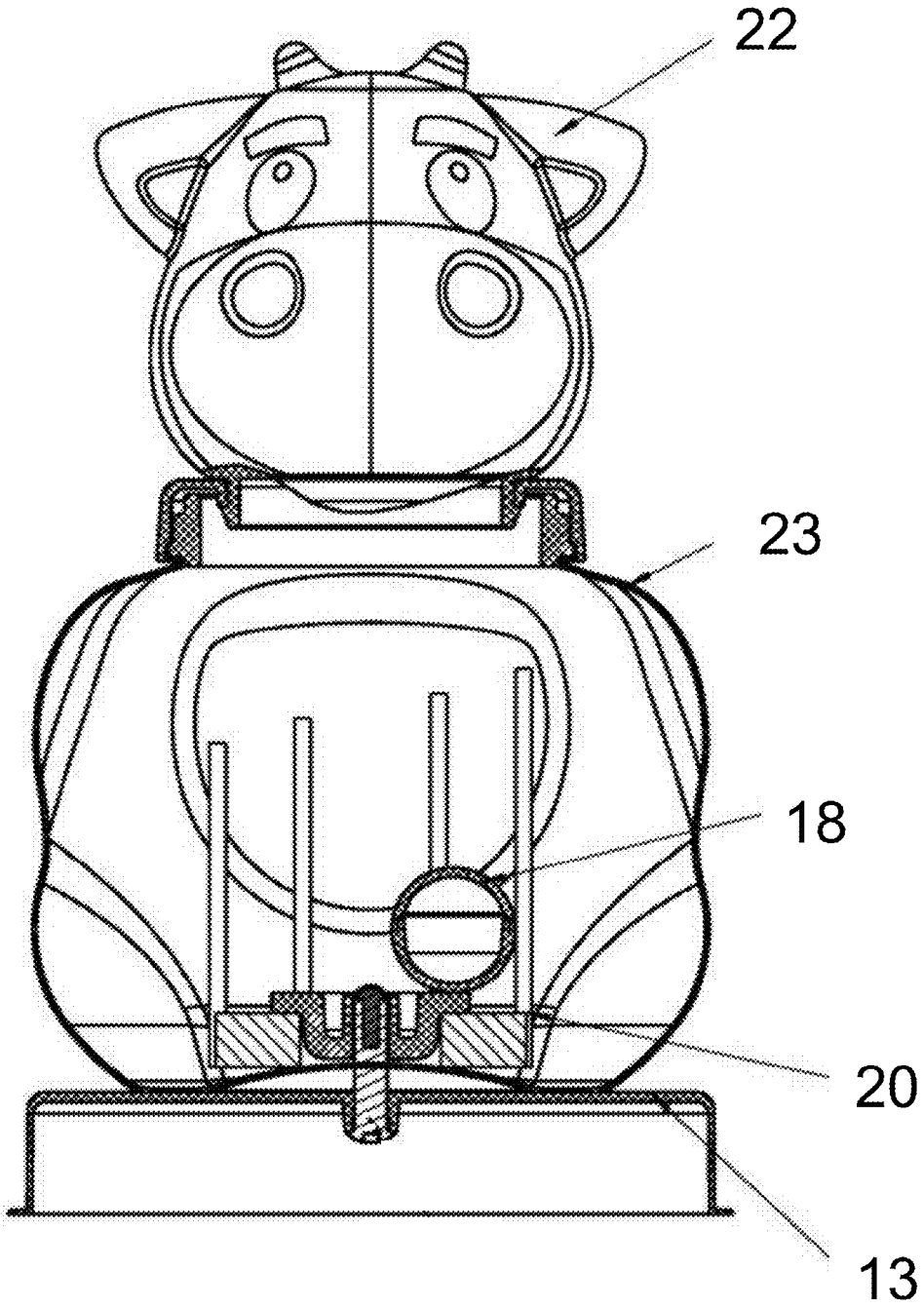
FIG. 11 is an assembled playing element with the membrane and tone mechanism.
Figure 12:
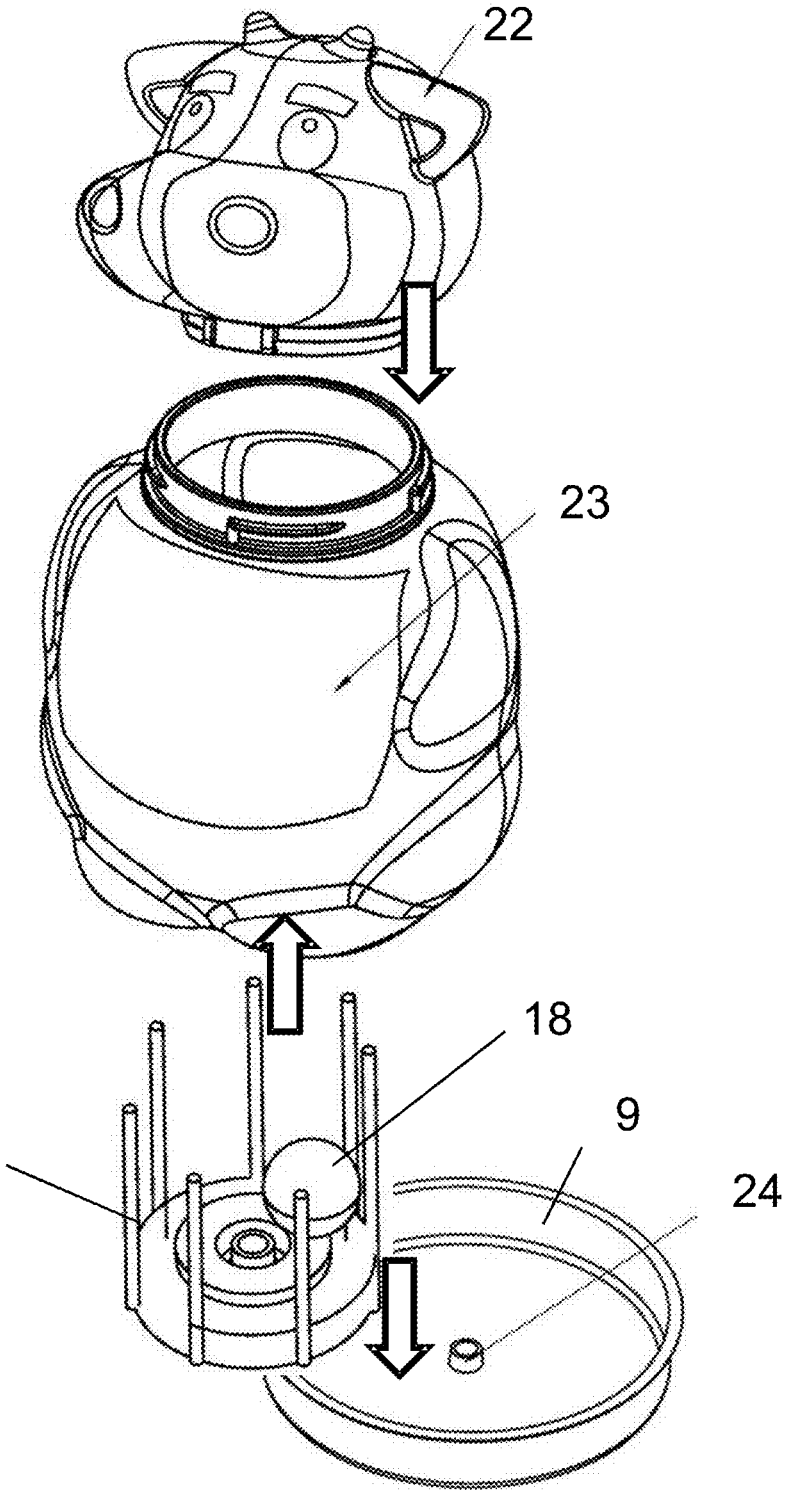
FIG. 12 is the same as the toy in FIG. 11, disassembled.

According to the second embodiment, a toy made as a ball is considered (see FIG. 10-12). The body construction comprising two parts, the mechanism of connection of the reservoir 1 with the cover 2 by means of the membrane 9. The construction of the membrane similar to the construction of the same elements according to the first embodiment. The second embodiment has no balls serving as the elements of sound making, but has a tuning-fork mechanism (FIG. 7, 8). This mechanism has a hammer in the form of a ball 18, arranged between the tuning forks in the form of rods 19 of different length, fixed to a support element 20. The hammer in the form of a ball 6 is arranged freely between the rods 7, which are fixed in a circumferential manner to the support element 20. The free ends of at least some of the rods are curved towards each other in order to limit the displacement of the ball along the rods (in order not to let the ball to fall out from the zone between the rods when the toy is rolling over).

The support element 20 has a central through hole, in which a supporting plate 21 is located by the central hole and with leaning on the surface of the support element 20.

The playing element is detachable, and includes at least two joinable parts. For example, on FIG. 11, 12 the playing element is made in the form of a thin-walled figure of a hippopotamus, comprising a head 22 and a body 23, which are connected to each other by any known method commonly used in production of toys (or dolls).

Figure 6:
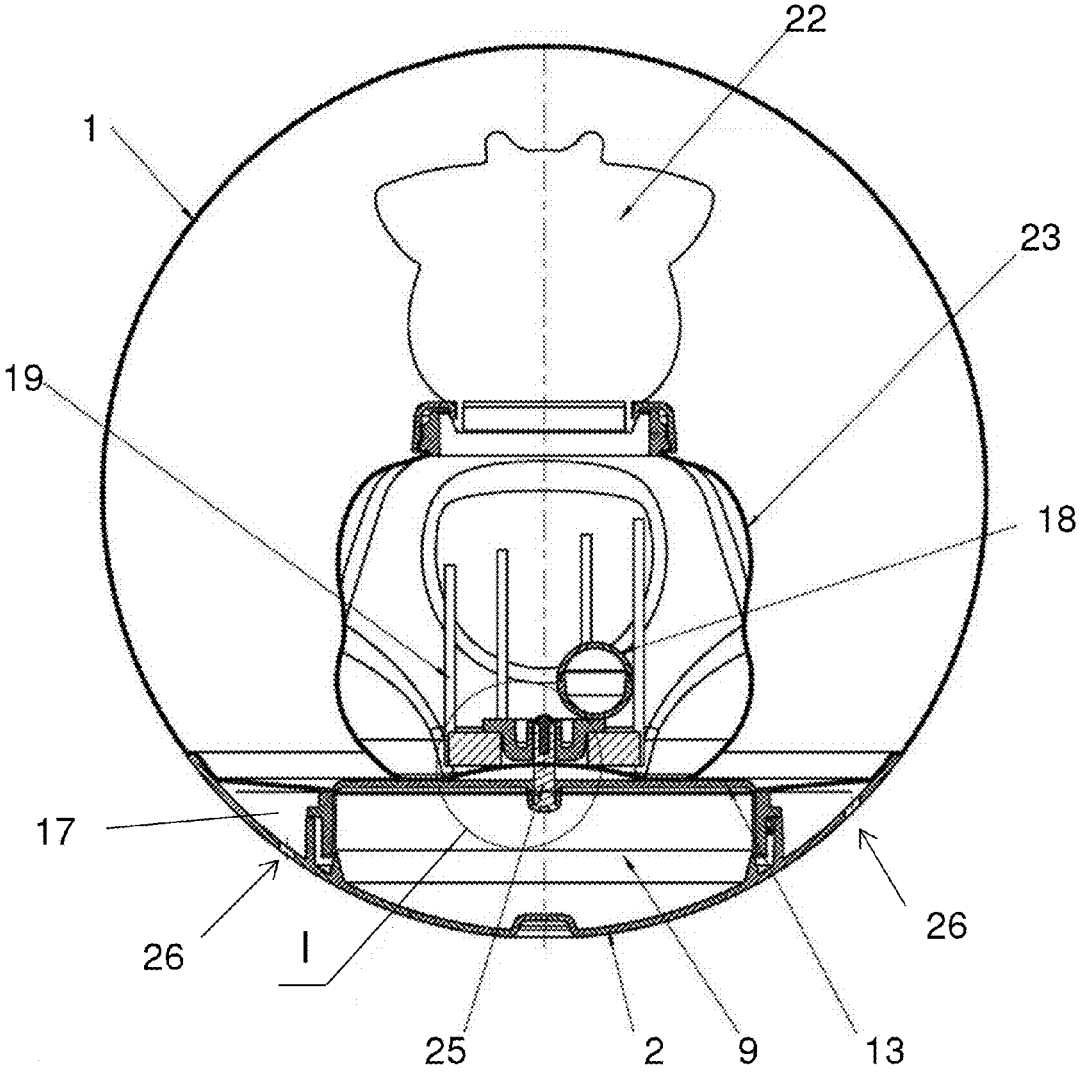
FIG. 6 illustrates a long section of the inventive toy in the form of a tumbler.

When assembled, the tuning-fork mechanism falls into the inner space of the body of the playing element to its bottom. In the center, the membrane 9 has a prominent cylindrical section 15 with a hole, into which a rivet 25 is put (FIG. 6, 9) to connect the membrane 9 to the hippopotamus and the tuning-fork mechanism. After that the head of the hippopotamus is connected to its body.

The cover 2 has the holes 26 (FIGS. 6 and 10) meant for penetration and draining of water into the inner space 7 between the external part of the reservoir 1 and the rattler's bottom.

Due to the collar 7 on the cover 2, water does not penetrate into the inner space of the membrane 9.

When playing on water, water gets through the holes 26 and is a weighting substance of the bottom part of the toy that makes it a tumbler toy.

A third embodiment of a toy, having the tuning-fork mechanism, duplicates the second embodiment of a tumbler toy regarding design of the body, membrane, the tuning-fork mechanism and its connection to the membrane. This embodiment of a musical toy has the cover without holes, the cover 2 is connected to the neck with a screw. For this purpose the external surface of the neck of the transparent reservoir has collars 27 (FIG. 13, 16) to form a screw line, the cover (FIG. 14, 15) has two collars spaced from top to bottom, the first of which directed along the long axis of the cover and bears inside the collars 28 to form a screw line.

Figure 13:
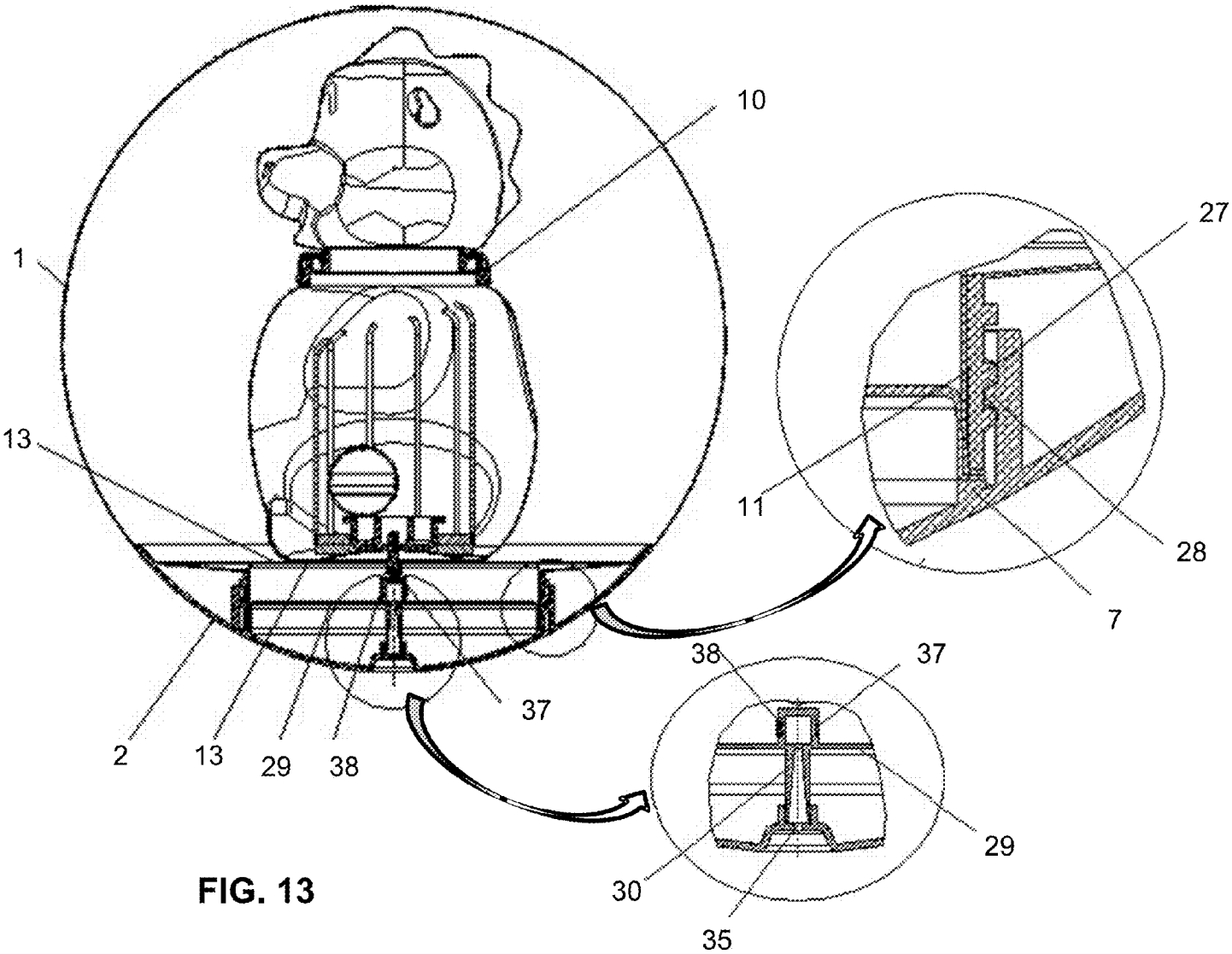
FIG. 13 illustrates a long section of the inventive toy in the form of a tumbler, of a second embodiment.
Figure 14:
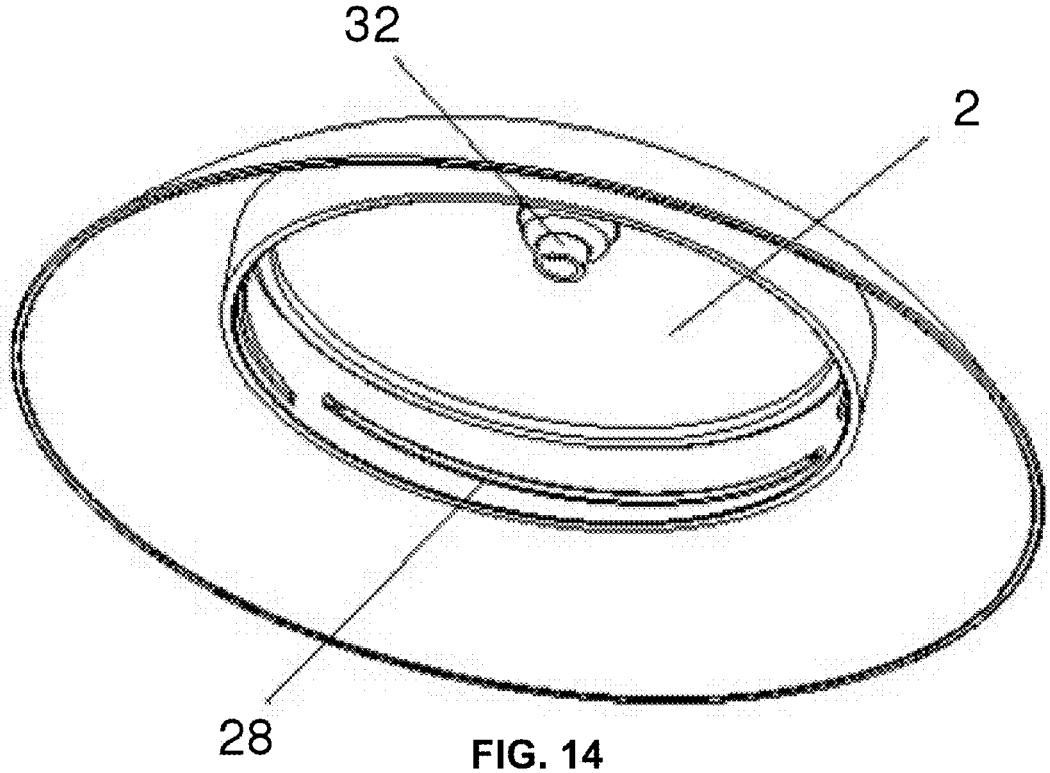
FIG. 14 is a general layout of the cover for the toy of FIG. 13 construction.
Figure 15:
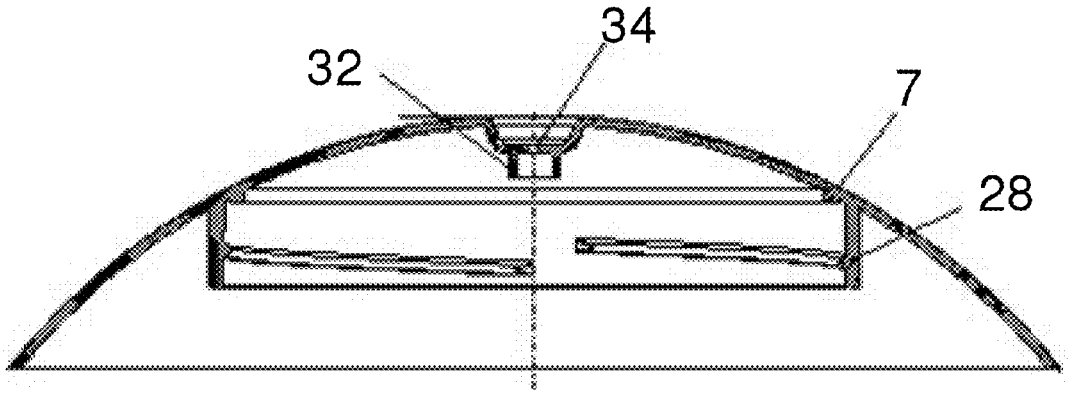
FIG. 15 is a vertical section of the cover of FIG. 14 construction.
Figure 16:
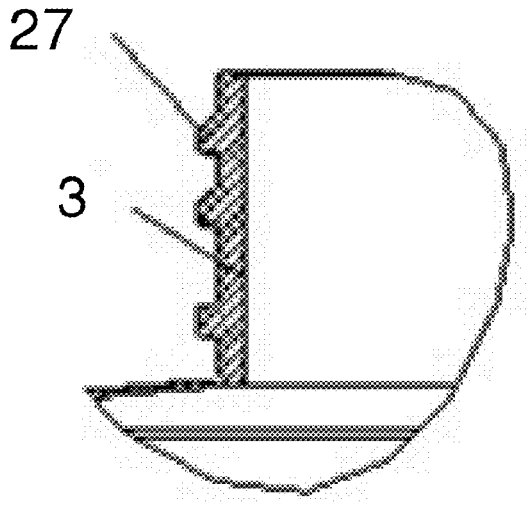
FIG. 16 is a section of the neck of the transparent reservoir of the toy of FIG. 13.
Figure 17:
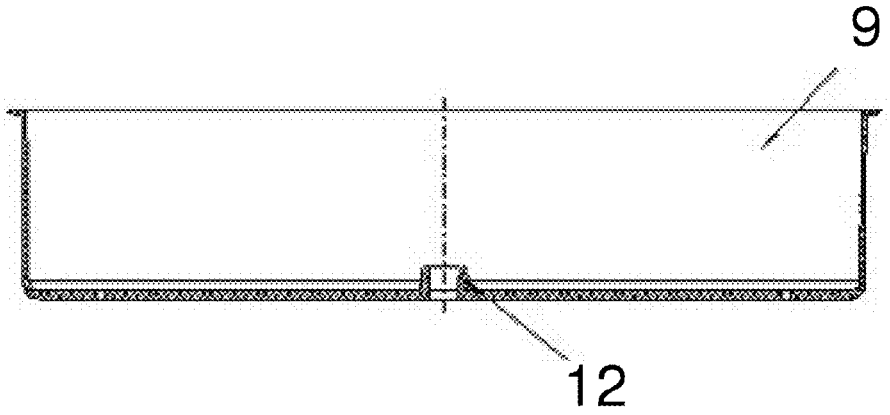
FIG. 17 is a membrane of the toy of FIG. 13 construction.
Figure 18:
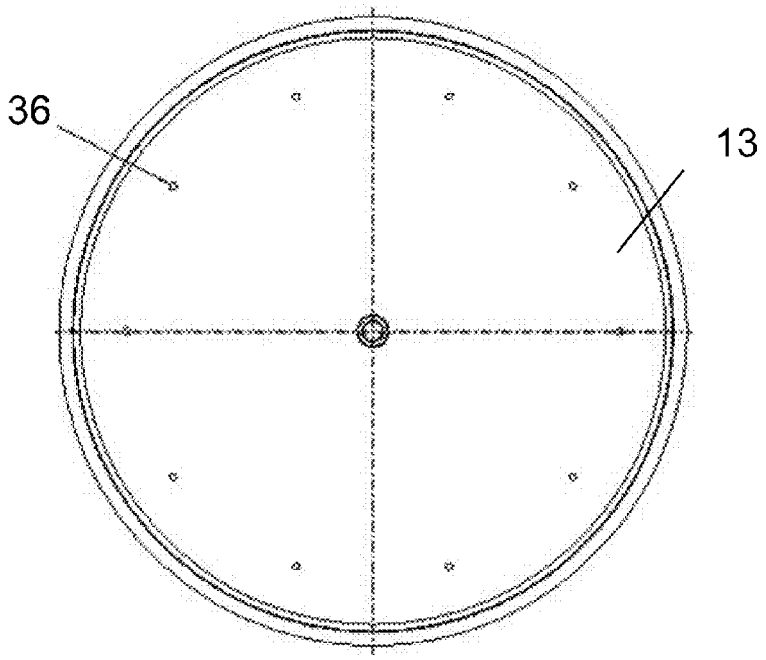
FIG. 18 is a plan view of the membrane of FIG. 17 construction.
Figure 19:
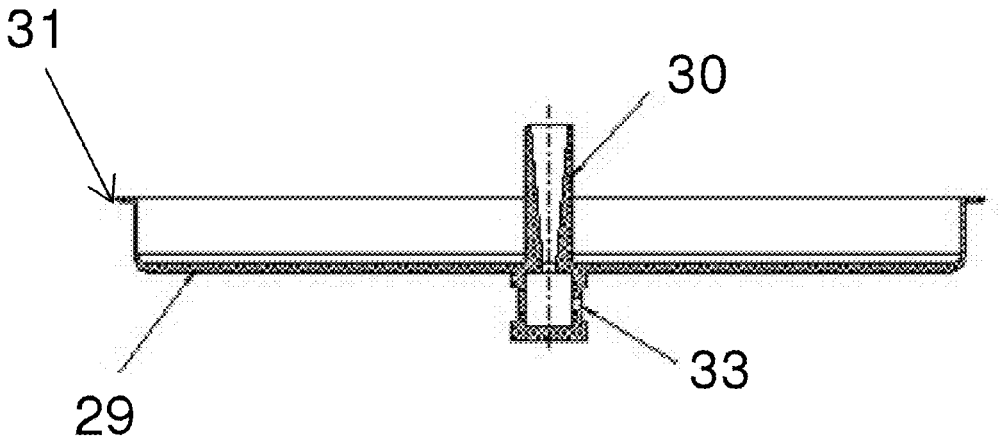
FIG. 19 is an additional membrane of the toy of FIG. 13 construction.

The attribute of a musical toy is that it is assembled with the air. For this purpose it has the additional membrane 29 with the nipple valve 30 (FIG. 13, 19). The nipple valve 30 is built into the membrane 9, which is made in the form of a thin-walled tumbler, the side board of which has a flange 31. Thus, the additional membrane 29 is put into the membrane 9, having the tuning-fork mechanism, and its flange 31, is located on the flanging 12 of the membrane 9 with the tuning-fork mechanism. Both membranes are mounted in the inner space of the neck 3 to locate the playing element 10 in the transparent part of the body and with leaning of the flanges on the end of the neck 3 and location of the side boards of both tumblers between the inner surface of the neck 3 and the second collar on the cover 2 (FIG. 13).

The cover 2 on the inner side is made with a housing 32 (FIG. 14, 15) to place a part 33 of the nipple valve 30 of the additional membrane 29, and in the housing there is a through hole 34 to have access to that nipple valve 30 when pumping air into the body's inner space. The membrane 29 with the nipple valve 30 is kept in the membrane 9 due to nipping of the side surfaces of the membrane 9 and the membrane with the nipple valve 30. Both membranes are pressed up by the collar 7 on the bottom of the cover 2. The cover 2 in the centre has a hole 35 for a needle of an air pump. The membrane with the nipple valve 30 has a guide for the needle and holes for air supply 13. Air is supplied through the nipple 30 with the help a standard needle to maintain excess pressure in the reservoir 1, to guarantee reliability and crease resistance of the toy. The membrane 9 on the top surface has holes 36 for air supply into the reservoir 1 through the membrane with the nipple 30. To prevent air escaping out of the reservoir 1 on the membrane-nipple valve interface, the seal ring 37 is put on, which has the side holes 38.

INDUSTRIAL APPLICABILITY

The present invention is applicable to toy manufacturing.

While the invention has been particularly shown and described with reference to preferred embodiments, it will be understood by those skilled in the art that various changes in form and detail may be made without departing from the spirit and scope of the invention. Any variations, modifications, additions, and improvements to the embodiments described are possible and may fall within the scope of the invention as detailed within the following claims.

The invention claimed is:

1. A rattle-tumbler toy, comprising:

a ball-shaped thin-walled body comprising first and second parts, the first part being a transparent reservoir and the second part being a non-transparent leak-proof cover connected to the first part of the body;

a membrane having a playing element mounted thereon, the membrane connected to the cover, wherein the transparent reservoir has a neck whose external surface has at least one collar for connection to mating parts on an internal surface of the cover when fastening the cover on the transparent reservoir, wherein, when the body is assembled, the playing element is mounted in the transparent reservoir, wherein the external surface of the neck has two collars spaced from top to bottom of the neck, wherein one of the two collars, which is located near an end of the neck, is open in at least two places, wherein the cover comprises two collars spaced from top to bottom, the first of the collars of the cover being arranged radially around a central vertical axis of the cover, the cover carrying a ring clamp inside, the ring clamp being open in at least two places, wherein the second collar of the cover is located inside the first collar, wherein the membrane is shaped as a thin-walled tumbler, such that along an edge of a side board there is a flange, and in a center of a bottom of the membrane there is a hole to pass a screw element to connect the playing element to an external surface of a bottom of the membrane, wherein the membrane is mounted in an inner space of the neck so that the playing element is in the transparent reservoir and wherein the flange is coupled to the end of the neck with the side board between an inner surface of the neck and the second collar on the cover;

a plurality of balls in the transparent reservoir; and a seal joining the cover to the transparent reservoir.

2. A rattle-tumbler toy, comprising:

a ball-shaped thin-walled body formed of a first part and a second part;

the first part being a transparent reservoir;

the second part being a non-transparent leak-proof cover connected to the first part;

a membrane having a playing element mounted thereon, the membrane being attached to the cover;

the transparent reservoir includes a neck whose external surface has at least one collar for connection to a mating element on an internal surface of the cover when fastening the cover on the transparent reservoir;

wherein, when the body is assembled, the playing element is mounted in the transparent reservoir and has a tuning-fork mechanism;

the playing element is detachable and includes at least two joinable parts;

wherein on the external surface of the neck there are two collars spaced from top to bottom of the neck, one of the collars, which is located near an end of the neck, is open in at least two places;

wherein the cover includes two additional collars, with the first additional collar oriented radially around a central vertical axis of the cover, and the first additional collar includes a ring clamp, which is open in at least two places, and the second additional collar is oriented radially around the central vertical axis of the cover and is located inside the first collar;

wherein the membrane is shaped as a thin-walled tumbler and has a flange along a side edge;

wherein, a center of a bottom of the membrane includes a hole for passing a screw element to connect the playing element to the bottom of the membrane;

wherein the membrane is mounted in an inner space of the neck to place the playing element in the transparent reservoir such that the flange leans on the end of the neck;

wherein the transparent reservoir has holes; and a seal at a connection area between the cover and the transparent reservoir.

3. A musical toy, comprising:

a ball-shaped thin-walled body having a transparent reservoir and a non-transparent cover connected to the transparent reservoir in a leak-proof manner;

a first membrane having a playing element with a tuning fork mounted thereon and connected to the cover;

the reservoir having a neck whose external surface has at least one collar mating with an internal surface of the cover when fastening the cover on the reservoir, such that when the body is inflated, the playing element is mounted in the transparent reservoir;

a second membrane having a nipple valve, wherein the second membrane is in a form of a thin-walled tumbler, wherein the playing element includes at least two joinable parts;

the at least one collar on the external surface of the neck forms a screw thread, the cover including first and second spaced-apart collars both being arranged radially around a central vertical axis of the cover, the first of the spaced-apart collars includes projections on its inner surface for forming a screw thread, and the second of the spaced-apart collars is located inside the first spaced-apart collar;

wherein the first membrane has a flange on its side and the second membrane has a flange on its side;

the second membrane having a hole in its center for passing a screw element to connect one part of the playing element with the tuning fork to a bottom of the second membrane when the second membrane is inserted into the first membrane such that the flange of the second membrane is coupled to the flange of the first membrane, the first and second membranes are mounted in an inner space of the neck to locate the playing element in the transparent reservoir, with the flanges of the membranes leaning against the neck;

a seal where the cover is coupled to the transparent reservoir;

an inner side of the cover having a fitting for a portion of the nipple valve of the second membrane, the fitting having a through hole for accessing the nipple valve.

* * * * *